US006040125A

United States Patent [19]

Siegel et al.

[11] Patent Number: 6,040,125

[45] Date of Patent: Mar. 21, 2000

[54] HIGH-SPEED COLOR PHOTOGRAPHIC RECORDING MATERIAL HAVING INCREASED SENSITIVITY IN THE BLUE SPECTRAL REGION

[75] Inventors: Jörg Siegel, Köln; Hans-Ulrich Borst, Elsdorf; Peter Bell, Köln; Ralf Büscher, Lohmar; Heinz Reif, Köln; Jürgen Jung, Leverkusen, all of Germany

[73] Assignee: Agfa-Gevaert NV, Germany

[21] Appl. No.: 09/042,401

[22] Filed: Mar. 13, 1998

[30] Foreign Application Priority Data

Mar. 18, 1997 [DE] Germany ..... 197 11 142

[51] Int. Cl.[7] ..... G03C 1/46

[52] U.S. Cl. ..... 430/506; 430/572; 430/574

[58] Field of Search ..... 430/506, 572, 430/574

[56] References Cited

U.S. PATENT DOCUMENTS 2,644,754 7/1953 Jennen et al. ..... 95/7
5,053,324 10/1991 Sasaki ..... 430/504

FOREIGN PATENT DOCUMENTS 409 019 3/1982 European Pat. Off. .
677 782 4/1995 European Pat. Off. .

*Primary Examiner*—Janet Baxter
*Assistant Examiner*—Amanda C. Walke
*Attorney, Agent, or Firm*—Connolly, Bove, Lodge & Hutz, LLP

[57] ABSTRACT

A color photographic recording material having at least one red-sensitive silver halide emulsion layer unit with which a cyan coupler is associated, at least one green-sensitive silver halide emulsion layer unit with which a magenta coupler is associated, at least one blue-sensitive silver halide emulsion layer unit with which a yellow coupler is associated, and optionally further light-insensitive layers, the blue-sensitive silver halide emulsion layer unit of which comprises at least two blue-sensitive partial layers which are sensitized with sensitizing dyes in such a way that a sensitivity curve ensues which is characterized by the following parameters:

$$460\ \text{nm} \leqq \lambda(S_{max}) \leqq 480\ \text{nm}$$

$$b_{80} \geqq 24\ \text{nm}$$

$$b_{50} \geqq 91\ \text{nm},$$

$$b_{20} \geqq 106\ \text{nm},$$

wherein $\lambda(S_{max})$ denotes the wavelength of the sensitivity maximum (100 % sensitivity);

$b_{80}$ denotes the width of the sensitivity curve at 80% of the maximum sensitivity;

$b_{50}$ denotes the width of the sensitivity curve at 50% of the maximum sensitivity;

$b_{20}$ denotes the width of the sensitivity curve at 20% of the maximum sensitivity, has an increased blue sensitivity compared with conventional color photographic recording materials.

4 Claims, 3 Drawing Sheets

HIGH-SPEED COLOR PHOTOGRAPHIC RECORDING MATERIAL HAVING INCREASED SENSITIVITY IN THE BLUE SPECTRAL REGION

This invention relates to a colour photographic recording material which has an increased sensitivity towards light from the blue spectral region, due to a special sensitization.

Figure 1:
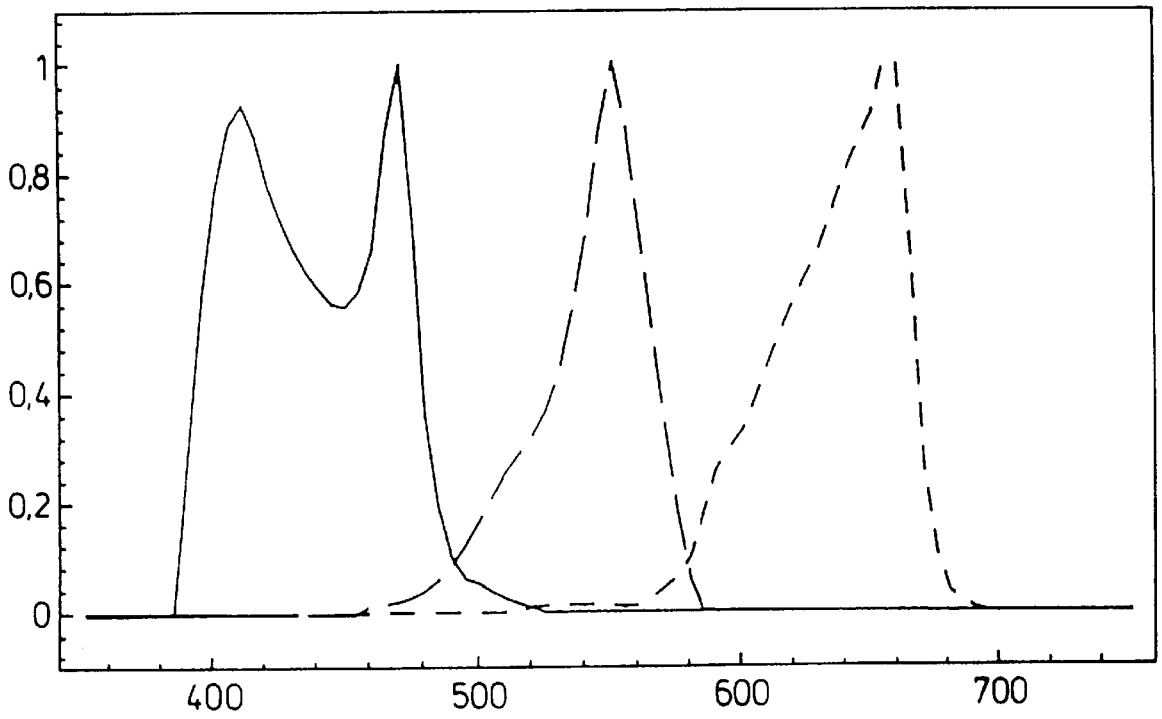

The blue-sensitive layer stack in colour negative films (CN films) is usually sensitized so that the sensitization maximum is situated at about 470 nm and the flanks of the sensitization band fall steeply towards the adjacent green spectral region. The sensitization curve of a typical CN film is reproduced in FIG. 1. Good colour separation and high brilliance of the CN film is achieved in this manner.

Attempts have been made time after time to improve the speed or the colour reproduction. For example, EP-A-0 409 019 describes a colour photographic recording material which exhibits improved colour reproduction, which is obtained, for example, by providing both the green-sensitive and the red-sensitive silver halide emulsion layers with an additional sensitization to light from the gap region between two adjacent main spectral regions, in the present case between green and red (580–620 nm) by the use of one or more so-called gap sensitization dyes. By this means, the adjacent spectral sensitivity curves are raised in the region of the secondary spectral sensitivity (gap), so that on exposure in this region 0.6 more logarithmic exposure units are necessary at most in order to produce the same colour density as in the region of the adjacent main spectral sensitivity.

In addition, attempts have been made time after time to increase the speed of the blue-sensitive layers by shifting the sensitization band towards longer wavelengths. In all cases, however, this has resulted in a deterioration of the colour reproduction. In particular, the colours yellow, yellow orange and green are shifted towards blue and become desaturated.

It has now been found that the speed of the blue-sensitive layer stack can be increased, without disadvantages for the colour reproduction, by widening the sensitization band symmetrically, i.e. towards both longer and shorter wavelengths, in the region of the main blue spectral absorption (460–480 nm) in all the partial layers of the blue-sensitive layer stack.

The present invention relates to a high-speed colour photographic recording material having at least one red-sensitive silver halide emulsion layer unit with which a cyan coupler is associated, at least one green-sensitive silver halide emulsion layer unit with which a magenta coupler is associated, at least one blue-sensitive silver halide emulsion layer unit with which a yellow coupler is associated, and optionally further light-insensitive layers, characterised in that the blue-sensitive silver halide emulsion layer unit comprises at least two blue-sensitive partial layers which are sensitized with sensitizing dyes in such a way that a sensitivity curve ensues which is characterised by the following parameters:

$$460\ \text{nm} \leqq \lambda(S_{max}) \leqq 480\ \text{nm}$$

$$b_{80} \geqq 24\ \text{nm}$$

$$b_{50} \geqq 91\ \text{nm}$$

$$b_{20} \geqq 106\text{nm},$$

wherein $\lambda(S_{max})$ denotes the wavelength of the sensitivity maximum (100% sensitivity);

$b_{80}$ denotes the width of the sensitivity curve at 80% of the maximum sensitivity;

$b_{50}$ denotes the width of the sensitivity curve at 50% of the maximum sensitivity;

$b_{20}$ denotes the width of the sensitivity curve at 20% of the maximum sensitivity.

Since the spectral sensitivity can depend, apart from the spectral sensitization, on the manner in which the spectral distribution of incident light is modified by absorption processes inside the layers, e.g. by filter dyes which absorb in the spectral sensitivity range, a more correct terminology is obtained by the use of the terms "sensitivity curve" and "sensitivity maximum" instead of "sensitization band" and "sensitization maximum". This applies in particular to blue-sensitive layers on account of the customary use of UV absorber compounds. For this reason, the first-mentioned terms are used in the description of the present invention when blue-sensitive layers are concerned, whilst the terms "sensitization band" and "sensitization maximum" are retained in connection with the description of green-sensitive or red-sensitive layers.

It will advantageously be ensured, in order to prevent too great an overlap with the adjacent sensitization band of the green-sensitive silver halide emulsion layer unit, that the sensitivity curve does not become arbitrarily wide. It is therefore advantageous for the colour reproduction quality if the width of the sensitivity curve does not exceed the following values:

$b_{80}$: 70 nm $b_{50}$: 145 nm $b_{20}$: 155 nm.

In one preferred embodiment of the invention, $b_{80} \geqq 40$ nm $b_{50} \geqq 107$ nm $b_{20} \geqq 124$ nm.

In an even more preferred embodiment of the invention, $70\ \text{nm} \geqq b_{80} \geqq 57\ \text{nm}$ $145\ \text{nm} \geqq b_{50} \geqq 124\ \text{nm}$ $155\ \text{nm} \geqq b_{20} \geqq 137\ \text{nm}$.

Adjustment of the sensitivity curve which is characterised according to the invention is achieved, for example, by starting from a mixture of sensitizing dyes for the sensitization of the respective layers, at least one of which dyes has a sensitization maximum in the region of the main spectral sensitivity, whilst one or more other sensitizing dyes of the mixture have a sensitization maximum which is shifted slightly towards shorter and/or longer wavelengths compared with the sensitization maximum of the first-mentioned sensitization dye, and by correspondingly increasing the proportion of the last-mentioned sensitization dyes in the mixture. In the present case, for example, a sensitizing dye which has its sensitization maximum shifted towards longer wavelengths ("long blue") can be admixed with a customary blue-sensitizing dye ("blue"), and the proportion of this admixed dye in the mixture can be correspondingly increased in order to obtain a widened sensitivity curve according to the invention. The same measure will advantageously be employed for all the partial layers of the blue-sensitive silver halide emulsion layer unit, although the dyes and/or the mixture ratios thereof in the different partial layers do not need to coincide. As an additional measure, which is mainly important for widening the blue sensitivity curve towards shorter wavelengths, it can be ensured that the content of UV absorber compounds which have an absorption maximum between 360 and 390 nm in layers disposed above the blue-sensitive silver halide emulsion layer unit is not more than 100 $mm^2$ in total.

Sensitization of the silver halide emulsions is effected in the usual manner. The sensitizing dyes can be added simultaneously as a mixture or individually in succession to the silver halide emulsion. It is even possible to add one or more sensitizing dyes during the grain growth phase and/or during chemical ripening.

It is advantageous if not only the blue sensitivity but also the green sensitivity and/or the red sensitivity is improved, i.e. if the partial layers of the green-sensitive and/or red-sensitive silver halide emulsion layer unit are also sensitized by suitable sensitizing dyes in such a way that a sensitization band ensues in all the partial layers thereof which is characterised by the following parameters:

green sensitivity:

$$540\ \text{nm} \leqq \lambda(S_{max}) \leqq 555\ \text{nm}$$

$$70\ \text{nm} \geqq b_{80} \geqq 36\ \text{nm}$$

$$95\ \text{nm} \geqq b_{50} \geqq 56\ \text{nm}$$

$$140\ \text{nm} \geqq b_{20} \geqq 89\ \text{nm}.$$

red sensitivity:

$$635\ \text{nm} \leqq \lambda(S_{max}) \leqq 660\ \text{nm}$$

$$70\ \text{nm} \geqq b_{80} \geqq 35\ \text{nm}$$

$$95\ \text{nm} \geqq b_{50} \geqq 56\ \text{nm}$$

$$145\ \text{nm} \geqq b_{20} \geqq 96\ \text{nm}.$$

In further preferred embodiments, the following parameters are applicable to the partial layers of the red-sensitive silver halide emulsion layer unit:

$b_{80} \geqq 49$ nm, and preferably $b_{80} \geqq 65$ nm $b_{50} \geqq 71$ nm, and preferably $b_{80} \geqq 89$ nm $b_{20} \geqq 111$ nm, and preferably $b_{80} \geqq 130$ nm and/or to the partial layers of the green-sensitive silver halide emulsion layer unit:

$b_{80} \geqq 41$ nm, and preferably $b_{80} \geqq 58$ nm $b_{50} \geqq 68$ nm, and preferably $b_{80} \geqq 85$ nm $b_{20} \geqq 98$ nm, and preferably $b_{80} \geqq 124$ nm.

Examples of colour photographic recording materials include colour negative films and colour reversal films in particular. A review of typical colour photographic materials and of preferred embodiments and processing procedures is given in Research Disclosure 37038 (February 1995).

These photographic materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part I (1995), page 285.

Colour photographic materials usually contain at least one red-sensitive, at least one green-sensitive and at least one blue-sensitive silver halide emulsion layer, and optionally also contain intermediate layers and protective layers.

Colour photographic films such as colour negative films and colour reversal films comprise, in the following sequence on their support: 2 or 3 red-sensitive, cyan-coupling silver halide emulsion layers, 2 or 3 green-sensitive, magenta-coupling silver halide emulsion layers, and 2 or 3 blue-sensitive, yellow-coupling silver halide emulsion layers. The layers of identical spectral sensitivity differ as regards their photographic sensitivity, wherein the less sensitive partial layers are generally disposed nearer the support than are the more highly sensitive partial layers.

A yellow filter layer is usually provided between the green-sensitive and blue-sensitive layers, and prevents blue light from reaching the layers underneath.

The options for different layer arrangements and their effects on photographic properties are described in J. Inf Rec. Mats., 1994, Vol. 22, pages 183–193.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE-A-25 30 645).

The essential constituents of the photographic emulsion layer are the binder, the silver halide grains and colour couplers.

Information on suitable binders is given in Research Disclosure 37254, Part 2 (1995), page 286.

Information on suitable silver halide emulsions, their production, ripening, stabilisation and spectral sensitization, including suitable spectral sensitizers, is given in Research Disclosure 36544 (Sept.1994) and Research Disclosure 37254, Part 3 (1995), page 286, and in Research Disclosure 37038, Part XV (1995), page 89.

Photographic materials which exhibit camera-sensitivity usually contain silver bromide-iodide emulsions, which may also optionally contain small proportions of silver chloride. Photographic copier materials contain either silver chloride-bromide emulsions comprising up to 80 mole % AgBr or silver chloride-bromide emulsions comprising more than 95 mole % AgCl.

Information on colour couplers is to be found in Research Disclosure 37254, Part 4 (1995), page 288, and in Research Disclosure 37038, Part II (1995), page 80. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm. The colour couplers are spatially and spectrally associated with the respective silver halide emulsion layer units or the partial layers thereof.

The term "spatial association" is to be understood to mean that the colour coupler is situated in a spatial relationship to the respective silver halide layer such that an interaction between them is possible which permits an image-by-image correspondence between the silver image formed on development and the coloured image produced from the colour coupler. This is generally achieved by the colour coupler being contained in the silver halide emulsion layer itself or in a binder layer adjacent thereto which is optionally insensitive to light.

The term "spectral association" is to be understood to mean that the spectral sensitivity of the respective light-sensitive silver halide emulsion and the colour of the partial colour image produced from the spatially associated colour coupler are in a defined relationship to each other, wherein a complementary partial colour image (cyan, magenta, yellow) is associated with the spectral sensitivity of each individual chromatic component (red, green, blue).

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, and in Research Disclosure 37038, Part XIV (1995), page 86.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 mm diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, and in Research Disclosure 37038, Part III (1995), page 84.

The photographic material may additionally contain compounds which absorb UV light, optical brighteners, spacers, filter dyes, formalin scavengers, light stabilisers, antioxidants, $D_{min}$ dyes, additives for improving dye-, coupler- and whiteness-stability and for reducing colour fogging, plasticisers (latices), biocides and other substances.

Suitable compounds are described in Research Disclosure 37254, Part 8 (1995), page 292, and in Research Disclosure 37038, Parts IV, V, VI, VII , XE and III (1995), page 84 et seq. The layers of colour photographic material are usually hardened, i.e. the binder which is used, preferably gelatine, is crosslinked by suitable chemical methods.

Suitable hardener substances are described in Research Disclosure 37254, Part 9 (1995), page 294, and in Research Disclosure 37038, Part XII (1995), page 86.

After image-by-image exposure, colour photographic materials are processed by different methods corresponding to their character. Details on the procedures used and the chemicals required therefor are published in Research Disclosure 37254, Part 10 (1995), page 294, and in Research Disclosure 37038, Parts XVI to XXII (1995), page 95 et seq., together with examples of materials.

EXAMPLE 1

A colour photographic recording material for the colour development of a colour negative was produced (layer structure 1—comparative) by depositing the following layers, in the given sequence, on a transparent film base of cellulose triacetate. The quantitative data are given with respect to 1 $m^2$ in each case. The corresponding amounts of $AgNO_3$ are given for the silver halide deposition. All the silver halide emulsions were stabilised with 0.5 g 4-hydroxy-6-methyl-1,3,3a,7-tetraazaindene per 1 mole of $AgNO_3$.

Layer structure 1

Layer 1: (anti-halo layer) black colloidal silver sol, comprising

| | |
|---|---|
| 0.3 g | Ag |
| 1.2 g | gelatine |
| 0.4 g | UV absorber XUV-1 |
| 0.02 g | tricresyl phosphate (TCP) |

Layer 2: (intermediate layer)

| | |
|---|---|
| 1.0 g | gelatine |

Layer 3: (1st red-sensitized layer, low sensitivity)

red-sensitized silver bromide-iodide emulsion (4 mole % iodide; average grain diameter 0.5 μm; spectrally sensitized with the sensitizing dyes XRS-1, XRS-2 and XRS-3 in a ratio of 1:3:0.5), comprising 2.7 g $AgNO_3$, with

| | |
|---|---|
| 2.0 g | gelatine |
| 0.88 g | cyan coupler XC-1 |
| 0.05 g | chromatic coupler XCR-1 |
| 0.07 g | chromatic coupler XCY-1 |
| 0.02 g | DIR coupler XDIR-1 |
| 0.75 g | TCP |

Layer 4: (2nd red-sensitized layer, high sensitivity)

red-sensitized silver bromide-iodide emulsion (12 mole % iodide; average grain diameter 1.0 μm; spectrally sensitized with the sensitizing dyes XRS-1, XRS-2 and XRS-3 in a ratio of 1:3.1:0.3), comprising 2.2 g $AgNO_3$, with

| | |
|---|---|
| 1.8 g | gelatine |
| 0.19 g | cyan coupler XC-2 |
| 0.17 g | TCP |

Layer 5: (intermediate layer)

| | |
|---|---|
| 0.4 g | gelatine |
| 0.15 g | white coupler XW-1 |
| 0.06 g | aluminium salt of aurintricarboxylic acid |

Layer 6: (1st green-sensitized layer, low sensitivity)

green-sensitized silver bromide-iodide emulsion (4 mole % iodide; average grain diameter 0.35 μm; spectrally sensitized with the sensitizing dyes XGS-1, XGS-2 and XGS-3 in a ratio of 2.8:1:0.2), comprising 1.9 g $AgNO_3$, with

| | |
|---|---|
| 1.8 g | gelatine |
| 0.54 g | magenta coupler XM-1 |
| 0.065 g | chromatic coupler XMY-1 |
| 0.24 g | DIR coupler XDIR-1 |
| 0.6 g | TCP |

Layer 7: (2nd green-sensitized layer, high sensitivity)

green-sensitized silver bromide-iodide emulsion (9 mole % iodide; average grain diameter 0.8 μm; spectrally sensitized with the sensitizing dyes XGS-1, XGS-2 and XGS-3 in a ratio of 2.8:0.9:0.25), comprising 1.25 g $AgNO_3$, with

| | |
|---|---|
| 1.1 g | gelatine |
| 0.195 g | magenta coupler XM-2 |
| 0.05 g | chromatic coupler XMY-2 |
| 0.245 g | TCP |

Layer 8: (yellow filter layer)

yellow colloidal silver sol, with

| | |
|---|---|
| 0.09 g | Ag |
| 0.25 g | gelatine |
| 0.08 g | scavenger XSC-1 |
| 0.40 g | formaldehyde scavenger XFF-1 |
| 0.08 g | TCP |

Layer 9: (1st blue-sensitized layer, low sensitivity)

blue-sensitized silver bromide-iodide emulsion (6 mole % iodide; average grain diameter 0.6 $\mu$m; spectrally sensitized with the sensitizing dye XBS-1) comprising 0.9 g $AgNO_3$, with

| | |
|---|---|
| 2.2 g | gelatine |
| 1.1 g | yellow coupler XY-1 |
| 0.037 g | DIR coupler XDIR-1 |
| 1.14 g | TCP |

Layer 10: (2blue-sensitized layer, high sensitivity)

blue-sensitized silver bromide-iodide emulsion (10 mole % iodide; average grain diameter 1.2 $\mu$m; spectrally sensitized with the sensitizing dye XBS-1), comprising 0.6 g $AgNO_3$, with

| | |
|---|---|
| 0.6 g | gelatine |
| 0.2 g | yellow coupler XY-1 |
| 0.003 g | DIR coupler XDIR-1 |
| 0.22 g | TCP |

Layer 11: (micrate layer)

micrate-silver bromide-iodide emulsion (0.5 mole % iodide; average grain diameter 0.06 $\mu$m), comprising 0.06 g $AgNO_3$, with

| | |
|---|---|
| 1.0 g | gelatine |
| 0.3 g | UV absorber XUV-2 |
| 0.3 g | TCP |

Layer 12: (protection and hardening layer)

| | |
|---|---|
| 0.25 g | gelatine |
| 0.75 g | hardener XH-1, |

so that the total layer structure after hardening had a swelling factor of 3.5.

Compounds used in layer structure 1:

XUV-1

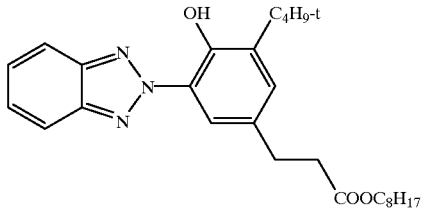

XUV-2

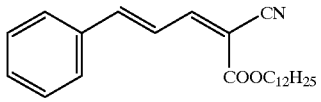

XW-1

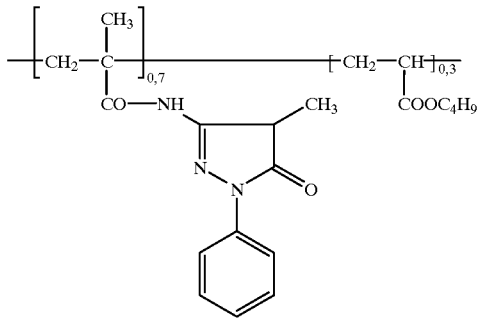

-continued
XC-1
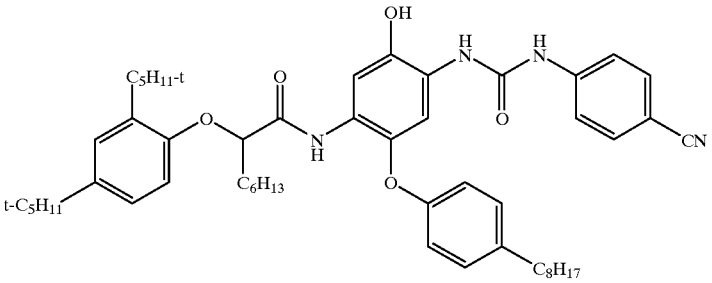
XC-2
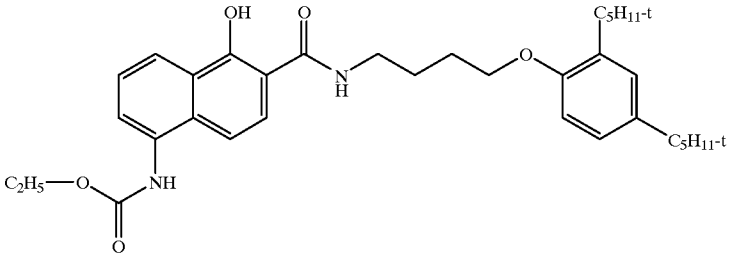
XCR-1
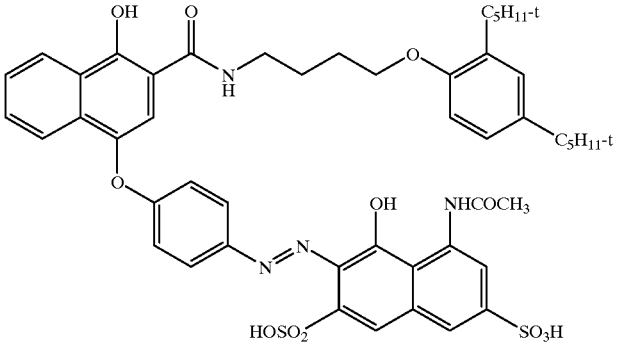
XCY-1
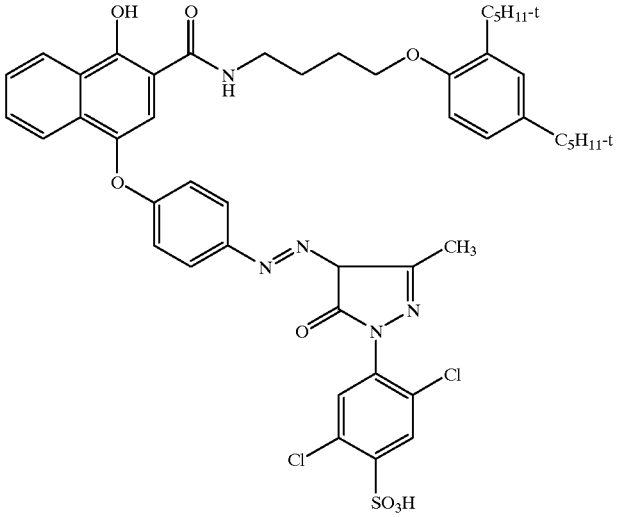

-continued
XM-1
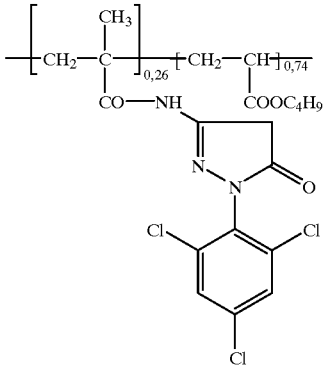
XM-2
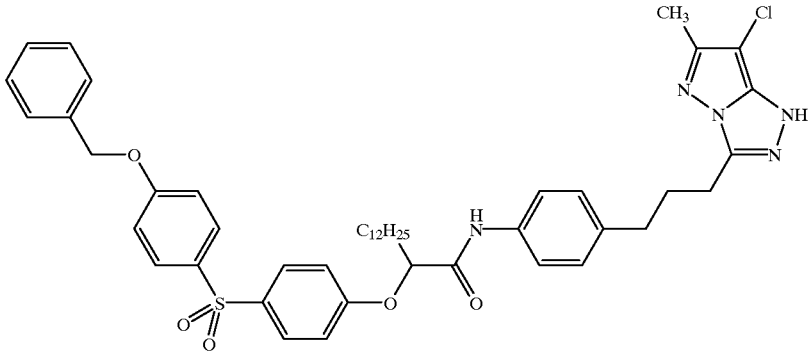
XMY-1
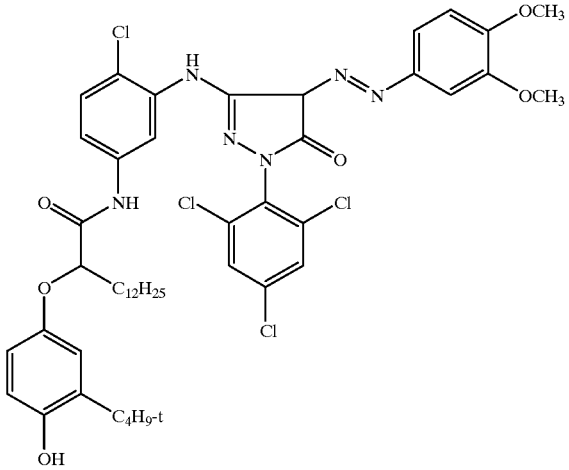
XMY-2
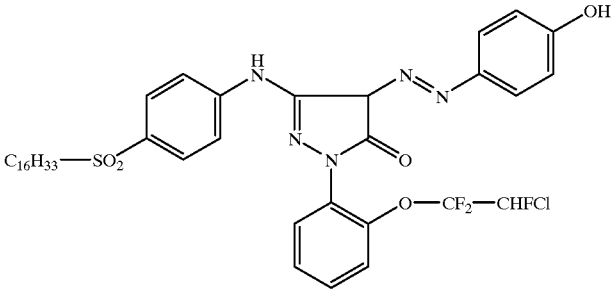

-continued
XY-1
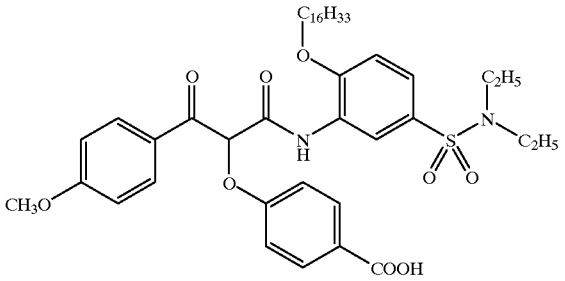
XDIR-1
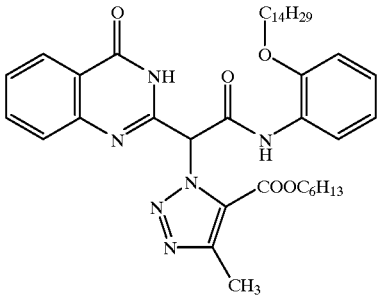
XSC-1
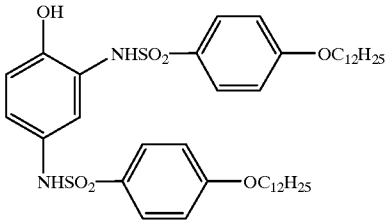
XH-1
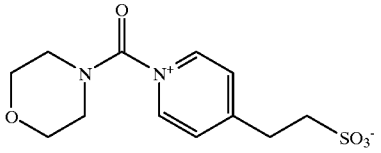
XFF-1
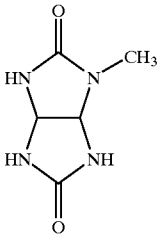
Sensitizing dyes are used in layer structure 1:
XRS-1
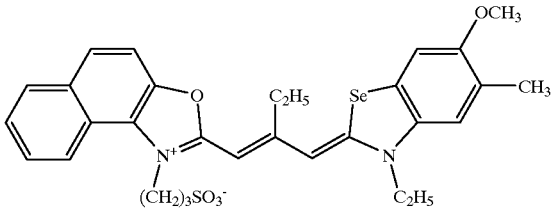

-continued

XRS-2

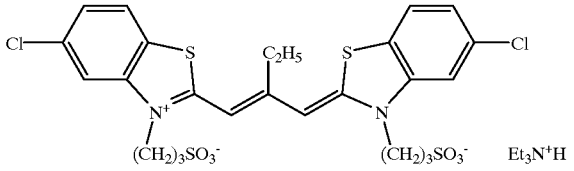

XRS-3

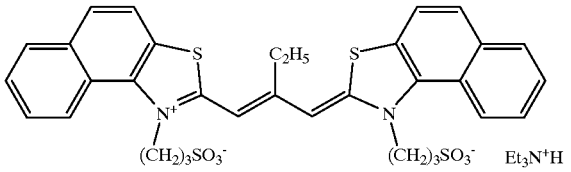

XGS-1

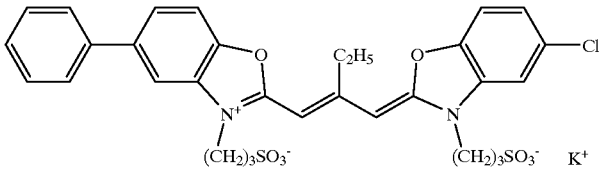

XGS-2

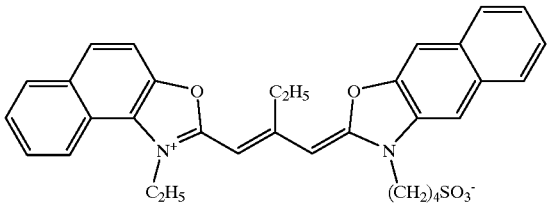

XGS-3

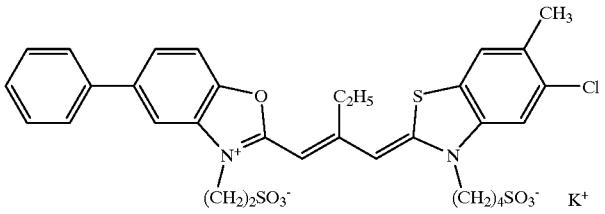

XBS-1

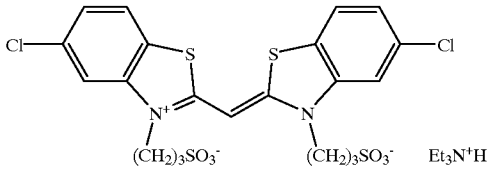

After exposure through a neutral wedge filter, the material was processed by a colour negative developing procedure which is described in "The British Journal of Photography", 1974, pages 597 and 198.

Figure 2:
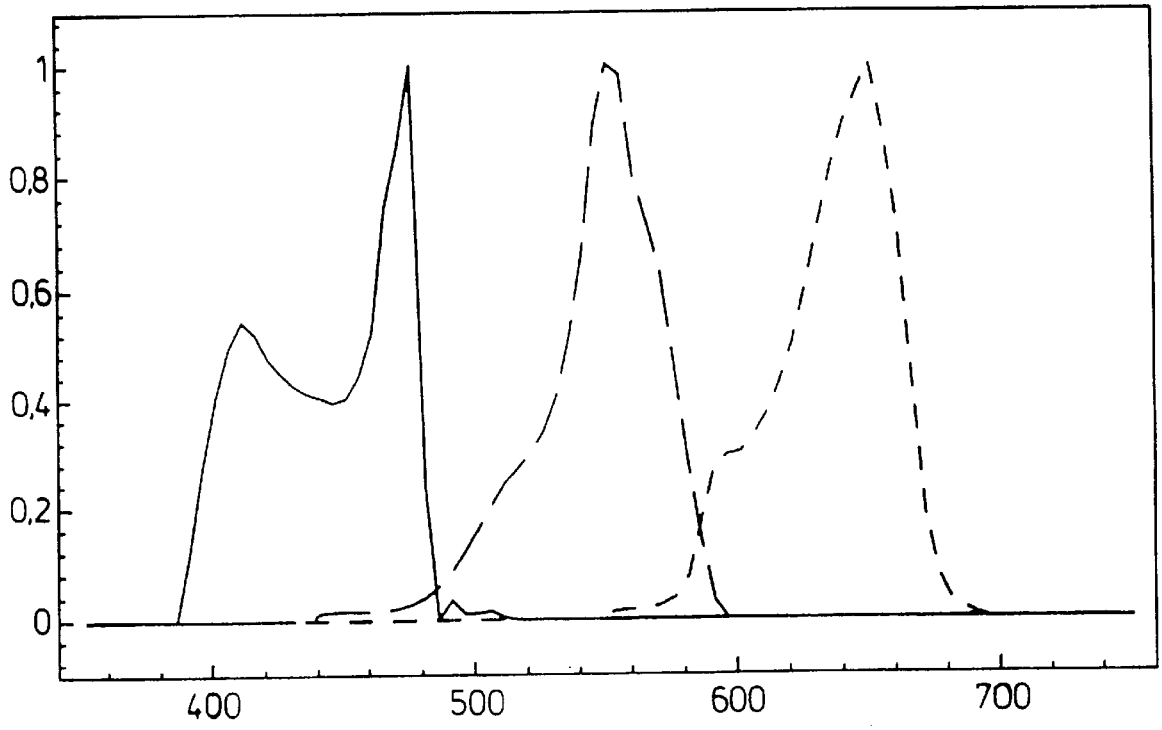

The sensitivity distribution illustrated in FIG. 2 was obtained with the test film produced in this manner.

In addition, the sensitivity maximum and the width of the [blue] sensitivity distribution at 80%, 50% and 20% with respect to the maximum intensity of the sensitization band ($b_{80}$, $b_{50}$, $b_{20}$) were used for the characterisation of this and of the sensitization variants according to the invention which are described below. The values shown in Table 1, row 1 (comparative) were obtained for the comparative example. The corresponding values ($b_{80}$, $b_{50}$, $b_{20}$, and the increase in sensitivity obtained) for layer structures 2–6 which are described in the following examples are also presented in Table 1.

TABLE 1

| Example (layer structure) | Width of the sensitivity distribution [nm] blue $b_{80}$ | $b_{50}$ | $b_{20}$ | Increase in sensitivity [%] |
|---|---|---|---|---|
| 1 comparative | 10 | 76 | 89 | — |
| 2 invention | 24 | 91 | 106 | 30 |
| 3 invention | 40 | 107 | 124 | 60 |
| 4 invention | 39 | 105 | 125 | 60 |
| 5 invention | 57 | 124 | 137 | 100 |

CIELAB measurements are usually employed for the calorimetric description of CN films. The method is described in detail, for example, by R. W. G. Hunt in "The Reproduction of Color", Fountain Press (1988). The colour reproduction is characterised by means of the luminance L and the chromaticity constants a and b. By means of these quantities, colour intervals DE can be determined which provide information on a change of colour saturation or on a shift of the colour shade. Experience has shown that a shift of 3–5 DE units is perceptible to the human eye.

Figure 3:
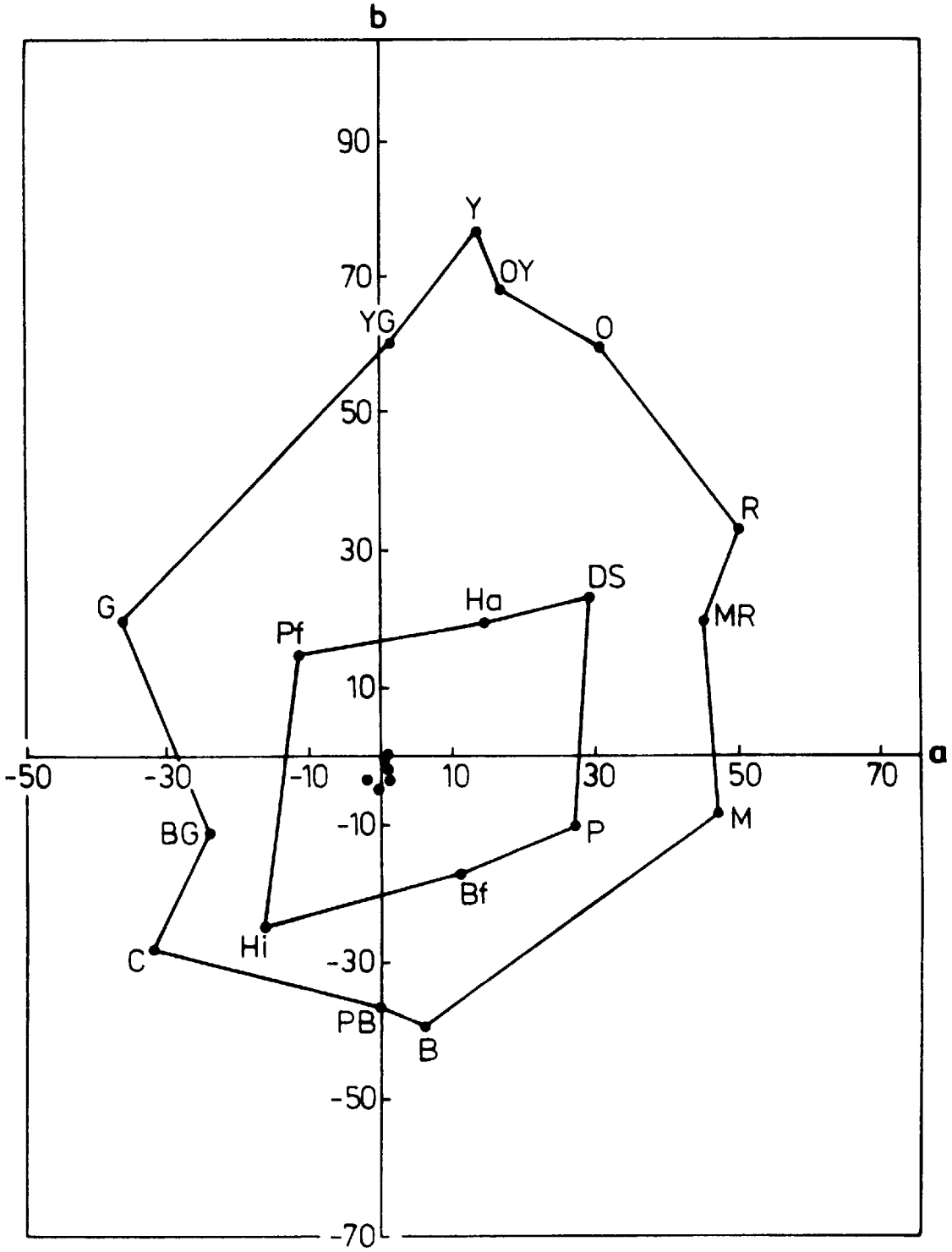

The colorimetric characterisation for layer structure 1 (comparative film) is given in Table 2, and FIG. 3 is a graphical representation of the chromaticity constants a and b.

For the test films according to the invention which are described in the following examples, the colorimetric description is given exclusively in the form of Tables, wherein the colour intervals ΔE were chosen for the characterisation. The following sensitizing dyes were also used in addition to those mentioned above: XBS-2

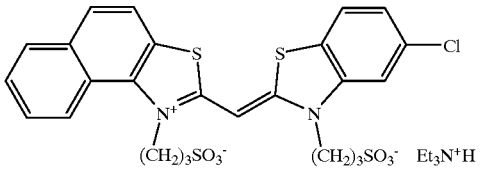

TABLE 2

Colorimetric characterisation of the comparative film (layer structure 1)

| No. | Colour | Name | L | a | b |
|---|---|---|---|---|---|
| 1 | DS | dark skin | 36.9 | 29.1 | 22.8 |
| 2 | Ha | light skin | 72.8 | 14.4 | 19.3 |
| 3 | Hi | blue sky | 50.1 | −16.2 | −24.7 |
| 4 | Pf | foliage | 35.4 | −11.4 | 14.7 |
| 5 | Bf | blue flower | 65.5 | 11.0 | −17.0 |
| 6 | BG | bluish green | 71.8 | −24.0 | −11.0 |
| 7 | O | orange | 58.0 | 30.9 | 59.2 |
| 8 | PB | purplish blue | 35.5 | −0.3 | −36.5 |
| 9 | MR | moderate red | 44.3 | 45.0 | 19.3 |
| 10 | P | purple | 28.8 | 26.9 | −10.3 |
| 11 | YG | yellow green | 71.6 | 1.4 | 60.0 |
| 12 | OY | orange yellow | 70.2 | 17.0 | 67.8 |
| 13 | B | blue | 21.3 | 6.1 | −39.4 |
| 14 | G | green | 43.8 | −36.3 | 19.9 |
| 15 | R | red | 33.3 | 50.2 | 32.6 |
| 16 | Y | yellow | 73.4 | 13.7 | 76.6 |
| 17 | M | magenta | 48.7 | 46.9 | −8.6 |
| 18 | C | cyan | 45.1 | −31.7 | −27.8 |
| 19 | grey_0.05 | white | 89.1 | 1.0 | −3.2 |
| 20 | grey_0.2 | neutral 8 | 84.5 | 0.8 | −1.8 |
| 21 | grey_0.4 | neutral 6.5 | 73.5 | 0.7 | 0.0 |
| 22 | grey_0.7 | neutral 5 | 49.7 | 0.2 | −0.4 |
| 23 | grey_1.05 | neutral 3.5 | 24.O | −2.0 | −3.4 |
| 24 | grey_1.5 | black | 8.5 | −0.4 | −4.5 |

The shift in colour reproduction compared with layer structure 1 which was obtained with layer structures 2–7 which are described in the following examples is presented in Table 3.

TABLE 3

Shift of the colour reproduction compared with layer structure 1 (colour difference ΔE)

| Layer structure | | Colour difference [ΔE] compared with layer structure 1 | | | | | |
|---|---|---|---|---|---|---|---|
| No. | colour | 2 | 3 | 4 | 5 | 6 | 7 |
| 1 | DS | 0.2 | 0.0 | 0.1 | 0.0 | 0.3 | 0.2 |
| 2 | Ha | 0.1 | 0.2 | 0.2 | 0.3 | 0.4 | 0.4 |
| 3 | Hi | 0.1 | 0.0 | 0.0 | 0.0 | 0.1 | 0.0 |
| 4 | Pf | 0.4 | 0.3 | 0.3 | 0.0 | 0.9 | 0.9 |
| 5 | Bf | 0.2 | 0.0 | 0.0 | 0.0 | 0.6 | 0.5 |
| 6 | BG | 0.4 | 0.3 | 0.3 | 0.1 | 0.8 | 0.7 |
| 7 | O | 0.4 | 0.2 | 0.3 | 0.1 | 0.6 | 0.6 |
| 8 | PB | 0.1 | 0.2 | 0.3 | 0.0 | 0.9 | 0.9 |
| 9 | MR | 0.4 | 0.0 | 0.0 | 0.2 | 0.6 | 0.6 |
| 10 | P | 0.1 | 0.0 | 0.0 | 0.4 | 0.2 | 0.1 |
| 11 | YG | 0.0 | 0.0 | 0.0 | 0.2 | 1.1 | 1.1 |
| 12 | OY | 0.3 | 0.2 | 0.3 | 0.1 | 1.0 | 1.0 |
| 13 | B | 0.2 | 0.4 | 0.4 | 0.1 | 1.6 | 1.7 |
| 14 | G | 0.0 | 0.0 | 0.0 | 0.1 | 1.5 | 1.6 |
| 15 | R | 0.3 | 0.2 | 0.2 | 0.0 | 0.2 | 0.2 |
| 16 | Y | 0.0 | 0.0 | 0.0 | 0.3 | 1.3 | 1.2 |
| 17 | M | 0.3 | 0.2 | 0.2 | 0.0 | 1.4 | 1.4 |
| 18 | C | 0.1 | 0.0 | 0.0 | 0.1 | 0.2 | 0.1 |
| 19 | grey_0.5 | 0.2 | 0.0 | 0.0 | 0.0 | — | — |
| 20 | grey_0.2 | 0.3 | 0.1 | 0.1 | 0.0 | — | — |
| 21 | grey_0.4 | 0.3 | 0.1 | 0.2 | 0.1 | — | — |
| 22 | grey_0.7 | 0.1 | 0.0 | 0.0 | 0.0 | — | — |
| 23 | grey_1.05 | 0.4 | 0.2 | 0.3 | 0.0 | — | — |
| 24 | grey_1.5 | 0.2 | 0.1 | 0.1 | 0.0 | 0.1 | 0.1 |

EXAMPLE 2

Layer structure 2 according to the invention differed from layer structure 1 as follows, namely by a reduced amount of UV absorber and by the addition of dye XBS-2, which absorbs at a longer wavelength:

| | UV absorber | | | |
|---|---|---|---|---|
| Layer | Type | Amount [g] | Dyes used | Mixture ratio |
| 9 | — | — | XBS-1, XBS-2 | 0.8:0.2 |
| 10 | — | — | XBS-1, XBS-2 | 0.8:0.2 |
| 11 | XUV-2 | 0.25 | — | — |

With this sensitization, the sensitivity compared with the comparative type was increased by about 30%.

The description of the sensitivity distribution (Table 1) shows a symmetrical widening of the sensitization band, particularly in the region of the main spectral sensitivity.

The calorimetric description (Table 3) shows that only slight changes in colour reproduction, which not in any case image-active, result in this manner.

EXAMPLE 3

Layer structure 3 according to the invention differed from layer structure 1 as follows:

| Layer | UV absorber Type | UV absorber Amount [g] | Dyes used | Mixture ratio |
|---|---|---|---|---|
| 9 | — | — | XBS-1, XBS-2 | 0.5:0.5 |
| 10 | — | — | XBS-1, XBS-2 | 0.55:0.45 |
| 11 | XUV-2 | 0.15 | — | — |

With this sensitization, the sensitivity compared with the comparative type was increased by about 60%.

The description of the sensitivity distribution (Table 1) shows a symmetrical widening of the sensitization band, particularly in the region of the main spectral sensitivity.

The calorimetric description (Table 3) shows that only slight changes in colour reproduction, which not in any case image-active, result in this manner.

EXAMPLE 4

Layer structure 4 according to the invention differed from layer structure 1 as follows:

| Layer | UV absorber Type | UV absorber Amount [g] | Dyes used | Mixture ratio |
|---|---|---|---|---|
| 9 | — | — | XBS-1, XBS-2 | 0.55:0.45 |
| 10 | — | — | XBS-1, XBS-2 | 0.6:0.4 |
| 11 | XUV-2 | 0.1 | — | — |

With this sensitization, the sensitivity compared with the comparative type was increased by about 60%.

The description of the sensitivity distribution (Table 1) shows a symmetrical widening of the sensitization band, particularly in the region of the main spectral sensitivity.

The colorimetric description (Table 3) shows that only slight changes in colour reproduction, which not in any case image-active, result in this manner.

EXAMPLE 5

Layer structure 5 according to the invention differed from layer structure 1 as follows:

| Layer | UV absorber Type | UV absorber Amount [g] | Dyes used | Mixture ratio |
|---|---|---|---|---|
| 9 | — | — | XBS-1, XBS-2 | 0.2:0.8 |
| 10 | — | — | XBS-1, XBS-2 | 0.15:0.85 |
| 11 | XUV-2 | 0.03 | — | — |

With this sensitization, the sensitivity compared with the comparative type was increased by about 100%.

The description of the sensitivity distribution (Table 1) shows a symmetrical widening of the sensitization band, particularly in the region of the main spectral sensitivity.

The colorimetric description (Table 3) shows that only slight changes in colour reproduction, which not in any case image-active, result in this manner.

EXAMPLE 6

In layer structure 6 according to the invention, spectral sensitization of the blue-, green- and red-sensitive layer stack was effected as follows:

| Layer | Dyes used | Mixture ratio |
|---|---|---|
| 3 | XRS-4, XRS-5, XRS-3 | 1:2:0.3 |
| 4 | XRS-4, XRS-5, XRS-3 | 1:2:0.28 |
| 6 | XGS-1, XGS-2, XGS-3 | 2.5:1:0.9 |
| 7 | XGS-1, XGS-2, XGS-3 | 2.5:1:1.0 |
| 9 | XBS-1, XBS-2 | 0.8:0.2 |
| 10 | XBS-1, XBS-2 | 0.8:0.2 |

In addition, the amount of UV absorber XV-2 in layer 11 was reduced to 0.25 $\mu m^2$.

In addition to the aforementioned sensitizing dyes, the following were also used:

XRS-4

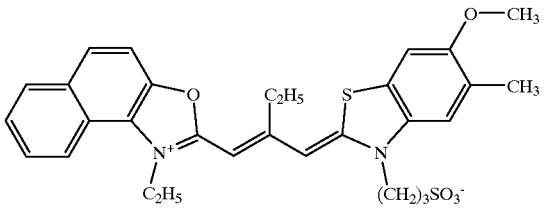

XRS-5

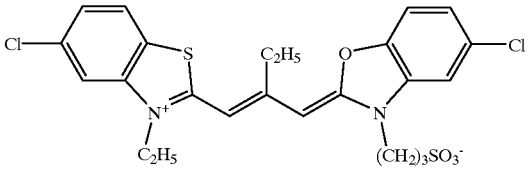

With this sensitization, the sensitivity compared with the comparative type was increased by 35% in all the partial layers. The description of the sensitivity distribution (Table 4) shows a symmetrical widening of the sensitization band, particularly in the region of the main spectral sensitivities. The calorimetric description (Table 3) shows that only slight changes in colour reproduction, which not in any case image-active, result in this manner.

EXAMPLE 7

In layer structure 7 according to the invention, spectral sensitization of the blue-, green- and red-sensitive layer stack was effected as follows:

| Layer | Dyes used | Mixture ratio |
|---|---|---|
| 3 | XGS-3, XRS-5, XRS-3 | 1:2:0.35 |
| 4 | XGS-3, XRS-2, XGS-3 | 1:2:0.40 |
| 6 | XGS-1, XGS-2, XGS-3 | 2.5:10:0.8 |
| 7 | XGS-1, XGS-2, XGS-3 | 26:1.0:0.9 |
| 9 | XBS-1, XBS-2 | 0.75:0.25 |
| 10 | XBS-1, XBS-2 | 0.75:0.25 |

In addition, the amount of UV absorber XUV-2 in layer 11 was reduced to 0.25 $g/m^2$.

With this sensitization, the sensitivity compared with the comparative type was increased by 30% in all the partial layers. The description of the sensitivity distribution (Table 4) shows a symmetrical widening of the sensitization band, particularly in the region of the main spectral sensitivities. The colorimetric description (Table 3) shows that only slight changes in colour reproduction, which not in any case image-active, result in this manner.

TABLE 4

| Example (layer structure) | Width of the sensitivity distribution [nm] blue $b_{80}$ | blue $b_{50}$ | blue $b_{20}$ | green $b_{80}$ | green $b_{50}$ | green $b_{20}$ | red $b_{80}$ | red $b_{50}$ | red $b_{20}$ | Increase in sensitivity [%] |
|---|---|---|---|---|---|---|---|---|---|---|
| 1 | 10 | 76 | 89 | 15 | 38 | 77 | 22 | 43 | 82 | — |
| 6 | 25 | 90 | 107 | 27 | 51 | 88 | 36 | 57 | 97 | 35 |
| 7 | 24 | 92 | 106 | 28 | 52 | 90 | 34 | 57 | 98 | 30 |

We claim:

1. A high-speed color photographic recording material which comprises at least one red-sensitive silver halide emulsion layer unit with which a cyan coupler is associated, at least one green-sensitive silver halide emulsion layer unit with which a magenta coupler is associated, at least one blue-sensitive silver halide emulsion layer unit with which a yellow coupler is associated and optionally further light-insensitive layers, and said blue-sensitive silver halide emulsion layer unit comprises at least two blue-sensitive partial layers which are sensitized with sensitizing dyes in such a way that a sensitivity curve ensues which is characterized by the following parameters:

$$460\ \text{nm} \leqq \lambda(S_{max}) \leqq 480\ \text{nm}$$

$$b_{80} \geqq 24\ \text{nm}$$

$$b_{50} \geqq 91\ \text{nm}$$

$$b_{20} \geqq 106\ \text{nm},$$

wherein

| | |
|---|---|
| $\lambda(S_{max})$ | denotes the wavelength of the sentivity curve maximum (100% sensitivity); |
| $b_{80}$ | denotes the width of the senitivity curse at 80% of the maximum sensitivity; |
| $b_{50}$ | denotes the width of the sensitivity curve at 50% of the maximum sensitivity; |
| $b_{20}$ | denotes the width of the sensitivity curve at 50% of the maximum sensitivity and the content of UV absorber compounds having an absorption maximum between 360 and 390 nm in layers disposed above the blue-sensitive silver halide emulsion layer unit amounts to not more than 100 mg/m$^2$ in total. |

2. The recording material according to claim 1, wherein the partial layers of the blue-sensitive silver halide emulsion layer unit are sensitized with sensitizing dyes in such a way that a sensitivity curve ensues which is characterized by the following parameters:

$$b_{80} \geqq 40\ \text{nm}$$

$$b_{50} \geqq 107\ \text{nm}$$

$$b_{20} \geqq 124\ \text{nm}.$$

3. The recording material according to claim 1, wherein the partial layers of the blue-sensitive silver halide emulsion layer unit are sensitized with sensitizing dyes in such a way that a sensitivity curve ensues which is characterized by the following parameters:

$$b_{80} \geq 57\ \text{nm}$$

$$b_{50} \geq 124\ \text{nm}$$

$$b_{20} \geq 137\ \text{nm}.$$

4. The recording material according to claim 1, wherein the red-sensitive silver halide emulsion layer unit also comprises at least two red-sensitive partial layers which are sensitized with sensitizing dyes in such a way that a sensitization band ensues which is characterized by the following parameters:

$$635\ \text{nm} \leqq \lambda(S_{max}) \leqq 660\ \text{nm}$$

$$b_{80} \geqq 35\ \text{nm}$$

$$b_{50} \geqq 56\ \text{nm}$$

$$b_{20} \geqq 96\ \text{nm},$$

and/or that the green-sensitive silver halide emulsion layer unit also comprises at least two green-sensitive partial layers which are sensitized with sensitizing dyes in such a way that a sensitization band ensues which is characterized by the following parameters:

$$540\ \text{nm} \leqq \lambda(S_{max}) \leqq 555\ \text{nm}$$

$$b_{80} \geqq 36\ \text{nm}$$

$$b_{50} \geqq 56\ \text{nm}$$

$$b_{20} \geqq 89\ \text{nm}.$$

* * * * *